US007186187B2

(12) United States Patent
Gilbert et al.

(10) Patent No.: US 7,186,187 B2
(45) Date of Patent: Mar. 6, 2007

(54) IRON-TYPE GOLF CLUBS

(75) Inventors: Peter J. Gilbert, Carlsbad, CA (US); Bruce R. Pettibone, Carlsbad, CA (US); Michael Scott Burnett, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 11/105,631

(22) Filed: Apr. 14, 2005

(65) Prior Publication Data

US 2006/0234806 A1 Oct. 19, 2006

(51) Int. Cl.
*A63B 53/02* (2006.01)

(52) U.S. Cl. ..... 473/290; 473/349; 473/350

(58) Field of Classification Search ..... 473/290–291
See application file for complete search history.

(56) References Cited

U.S. PATENT DOCUMENTS 3,655,188 A * 4/1972 Solheim ..... 473/290
4,420,156 A 12/1983 Campau
4,645,207 A * 2/1987 Teramoto et al. ..... 473/290
4,928,972 A 5/1990 Nakanishi et al.
5,388,826 A 2/1995 Sherwood
5,429,353 A * 7/1995 Hoeflich ..... 473/350
5,480,145 A 1/1996 Sherwood
5,547,426 A * 8/1996 Wood ..... 473/290
5,562,551 A * 10/1996 Rife ..... 473/291
5,591,092 A 1/1997 Gilbert
5,967,903 A 10/1999 Cheng
5,976,029 A 11/1999 Sherwood
6,045,456 A 4/2000 Best et al.
6,196,934 B1 3/2001 Sherwood
6,290,607 B1 * 9/2001 Gilbert et al. ..... 473/291
D473,606 S * 4/2003 Mickelson et al. ..... D21/747
6,547,675 B2 4/2003 Sherwood
6,605,007 B1 8/2003 Bissonnette et al.
6,814,674 B2 * 11/2004 Clausen et al. ..... 473/342
6,849,005 B2 * 2/2005 Rife ..... 473/350
6,863,621 B2 3/2005 Sherwood
2002/0082108 A1 * 6/2002 Peters et al. ..... 473/291
2003/0181259 A1 * 9/2003 Shimazaki ..... 473/350
2005/0044691 A1 * 3/2005 Su ..... 29/527.5

FOREIGN PATENT DOCUMENTS

JP 2002-186694 * 7/2002

* cited by examiner

*Primary Examiner*—Stephen Blau
(74) *Attorney, Agent, or Firm*—Kristin D. Wheeler

(57) ABSTRACT

A set of iron-type golf clubs includes long irons with cavity back configurations and short irons with muscle back configurations. The rear face configurations slowly transition from pure cavity back through cavity-muscle backs to pure muscle backs for increased performance continuum for the set. Additional design parameters for the set may also be systematically varied through the set, such as face area, loft angle, offset and location of the center of gravity.

22 Claims, 12 Drawing Sheets

IRON-TYPE GOLF CLUBS

FIELD OF THE INVENTION

This invention generally relates to golf clubs, and, more particularly, to a set of iron-type clubs.

BACKGROUND OF THE INVENTION

Individual iron club heads in a set typically increase progressively in face surface area and weight as the clubs progress from the long irons to the short irons and wedges. Therefore, the club heads of the long irons have a smaller face surface area than the short irons and are typically more difficult for the average golfer to hit consistently well. For conventional club heads, this arises at least in part due to the smaller sweet spot of the corresponding smaller face surface area.

To help the average golfer consistently hit the sweet spot of a club head, many golf clubs are available with cavity back constructions for increased perimeter weighting. Perimeter weighting also provide the club head with higher rotational moment of inertia about its center of gravity. Club heads with higher moment of inertia have a lower tendency to rotate caused by off-center hits. Another recent trend has been to increase the overall size of the club heads, especially in the long irons. Each of these features increases the size of the sweet spot, and therefore makes it more likely that a shot hit slightly off-center still makes contact with the sweet spot and flies farther and straighter. One challenge for the golf club designer when maximizing the size of the club head is to maintain a desirable and effective overall weight of the golf club. For example, if the club head of a three iron is increased in size and weight, the club may become more difficult for the average golfer to swing properly.

In general, to increase the sweet spot, the center of gravity of these clubs is moved toward the bottom and back of the club head. This permits an average golfer to get the ball up in the air faster and hit the ball farther. In addition, the moment of inertia of the club head is increased to minimize the distance and accuracy penalties associated with off-center hits. In order to move the weight down and back without increasing the overall weight of the club head, material or mass is taken from one area of the club head and moved to another. One solution has been to take material from the face of the club, creating a thin club face. Examples of this type of arrangement can be found in U.S. Pat. Nos. 4,928,972, 5,967,903 and 6,045,456.

However, for a set of irons, the performance characteristics desirable for the long irons generally differ from that of the short irons. For example, the long irons are more difficult to hit accurately, even for professionals, so having long irons with larger sweet spots is desirable. Similarly, short irons are generally easier to hit accurately, so the size of the sweet spot is not as much of a concern. However, greater workability of the short irons is often demanded.

Currently, in order to produce the best overall game results, golfers may have to buy their clubs individually, which results in greater play variation through the set than is desirable. Therefore, there exists a need in the art for a set of clubs where the individual clubs in the set are designed to yield an overall maximized performance continuum for the set.

SUMMARY OF THE INVENTION

Hence, the invention is directed to a set of iron-type golf clubs including at least one cavity back club and at least one muscle back club, where the clubs are made from forged stainless steel.

Another aspect of the invention is directed to a set of iron-type golf clubs comprising at least three clubs, wherein an offset (O) for each club is in accordance with $$O=\alpha*(-0.0025*LA+0.2)$$

wherein LA is a loft angle measured in degrees, and $\alpha$ ranges from about 0.89 to about 1.11.

In one aspect of the invention, $\alpha$ is a factor that accounts for the coefficient of determination and/or the design tolerance.

Another aspect of the invention is directed to a set of iron-type golf clubs comprising at least three clubs, wherein a club head face area (FA) for each club is in accordance with $$FA=\alpha*(0.01*LA+4.71)$$

wherein LA is a loft angle measured in degrees, and $\alpha$ ranges from about 0.98 to about 1.02.

Another aspect of the invention is directed to a set of iron-type golf clubs comprising at least three clubs, wherein a club head center of gravity with respect to ground ($CG_y$) is in accordance with $$CG_y=\alpha*(0.05*LA+16.14)$$

wherein LA is a loft angle measured in degrees and $\alpha$ ranges from about 0.8 to about 1.2.

Another aspect of the invention is directed to a set of iron-type golf clubs comprising at least three clubs, wherein a club head top line width (TLW) is in accordance with $$TLW=\alpha*(-0.0023*LA+0.3)$$

wherein LA is a loft angle measured in degrees and $\alpha$ ranges from about 0.75 to about 1.25.

Another aspect of the invention is directed to a set of iron-type golf clubs comprising at least three clubs, wherein a club head sole width (SW) is in accordance with $$SW=\alpha*(-0.0044*LA+0.79)$$

wherein LA is a loft angle measured in degrees and $\alpha$ ranges from about 0.75 to about 1.25.

Another aspect of the invention is directed to a set of iron-type golf clubs comprising at least three clubs, wherein a club head cavity volume (CV) for a long iron or a mid-length iron is in accordance with $$CV=\alpha*(-0.29*LA+13.85)$$

wherein LA is a loft angle measured in degrees and $\alpha$ ranges from about 0.75 to about 1.25.

Another aspect of the invention is directed to a set of iron-type golf clubs comprising at least three clubs, wherein a club head center of gravity measured from ground while a club is in an address position ($CG_y$) is in accordance with $$CG_y=\alpha*(0.05*LA+16.14)$$

wherein LA is a loft angle measured in degrees and $\alpha$ ranges from about 0.75 to about 1.22.

Another aspect of the invention is directed to a set of iron-type golf clubs comprising at least three clubs, wherein a club head moment of inertia about a horizontal axis that passes through a center of gravity of a club head hitting face is in accordance with $$I_{xx}=\alpha*(0.75LA+29.56)$$

wherein LA is a loft angle measured in degrees and α ranges from about 0.8 to about 1.2.

Another aspect of the invention is directed to a set of iron-type golf clubs comprising at least three clubs, wherein a club head moment of inertia about a vertical axis that passes through a center of gravity of a club head hitting face is in accordance with $$I_{yy}=\alpha*(0.9LA_{deg}+190.48)$$

wherein LA is a loft angle measured in degrees and α ranges from about 0.8 to about 1.2.

Another aspect of the invention is directed to a set of iron-type golf clubs comprising at least three clubs, wherein a club head moment of inertia about a shaft axis is in accordance with $$I_{sa}=\alpha*(3.87LA+383.88)$$

wherein LA is a loft angle measured in degrees and α ranges from about 0.8 to about 1.2.

In one aspect of the present invention, α can be defined as a factor that incorporates design tolerances and the coefficient of determination.

BRIEF DESCRIPTION OF THE DRAWINGS

In the accompanying drawings, which form a part of the specification and are to be read in conjunction therewith and in which like reference numerals are used to indicate like parts in the various views.

DETAILED DESCRIPTION OF THE PREFERRED EMBODIMENTS

Figure 1:
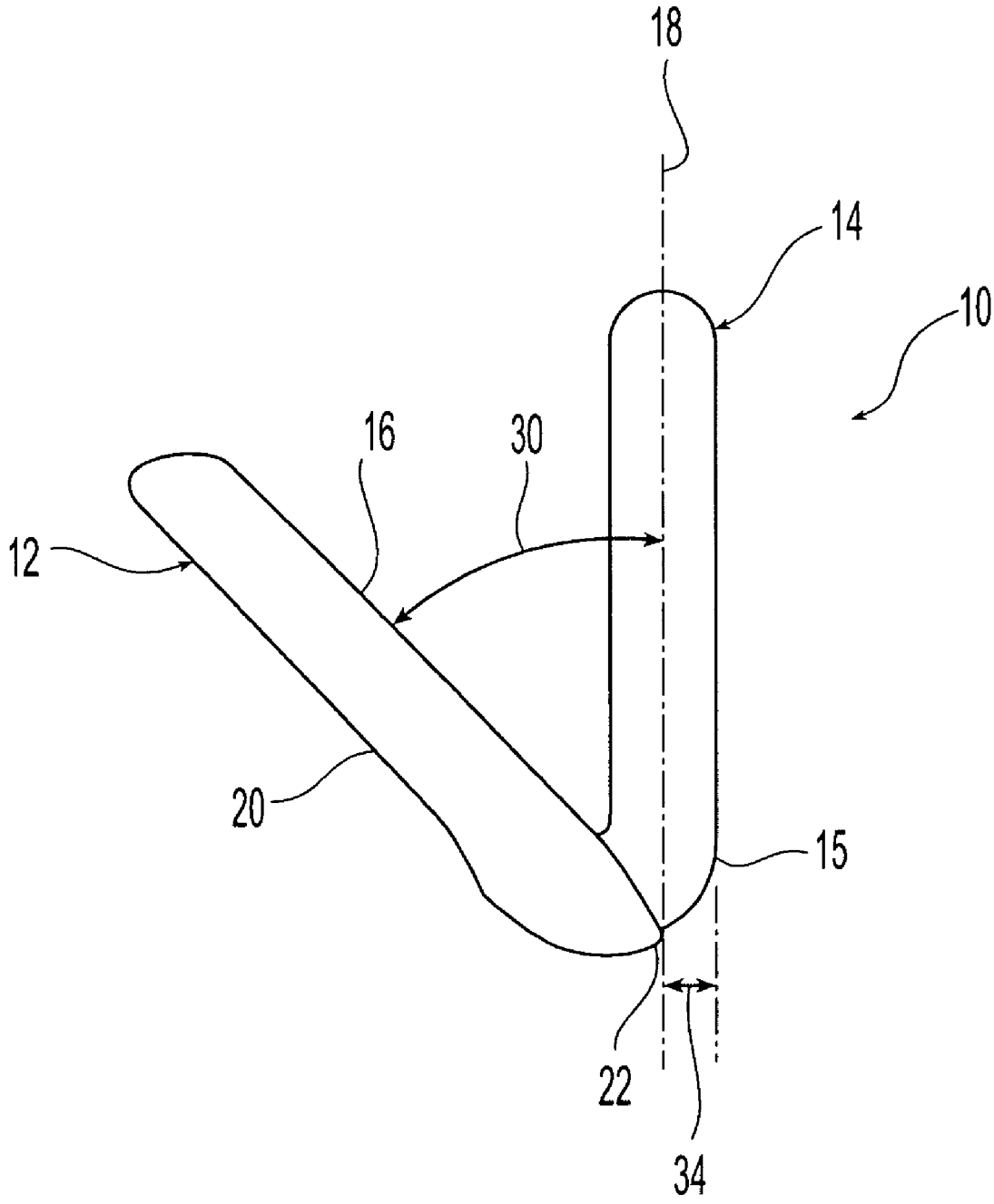
FIG. 1 is a toe view of a club head.

As illustrated in the accompanying drawings and discussed in detail below, the present invention is directed to a set of iron-type golf clubs, wherein the clubs are a blended set of cavity back-type clubs, muscle back-type clubs, and, preferably, transitional cavity-muscle-type clubs. For the purposes of illustration, FIG. 1 shows a reference iron-type club head 10 for defining various design parameters for the present invention. These design parameters for the clubs are chosen such that the parameters progress through the set from the long irons to the short irons in a pre-determined fashion. Club head 10 is attached to a shaft (not shown) in any manner known in the art.

Club head 10 includes, generally, a body 12 and a hosel 14. Body 12 includes a striking or hitting face 16 and a rear face 20. Body 12 is attached to hosel 14 at an angle, such that a loft angle 30 is defined between a hosel center line 18 and hitting face 16. Further, the relative configuration of body 12 and hosel 14 results in an offset 34 between the leading edge 22 of the base of the hitting face and the forward-most point 15 of the hosel.

In typical sets of golf clubs, the area of hitting face 16, the heel-to-toe length of body 12, loft angle 30, and offset 34 vary from club to club within the set. For example, long irons, such as a 2- or 3-iron using conventional numbering, typically include relatively long shafts, relatively large areas for hitting face 16, and relatively low loft angles 30. Similarly, short irons, such as an 8- or 9-iron using conventional numbering, typically include relatively short shafts, relatively small areas for hitting face 16, and relatively high loft angles 30. In the present invention, these parameters are particularly chosen to maximize the performance of each club for its intended use. Further, these parameters progress in a predetermined fashion through the set.

One such parameter is the configuration of rear face 20. In typical sets of golf clubs, rear face 20 has either a "cavity back", i.e., a substantial portion of the mass of the club head is positioned on the back side around the perimeter 32 of the club head, or a "muscle back", where the mass of the club is relatively evenly distributed along the heel-to-toe length of body 12. Cavity back clubs tend to have larger sweet spots, lower centers of gravity, and higher inertia. In other words, cavity back clubs are easier to produce true hits. In long irons, the sweet spot can be difficult to hit accurately. Therefore, it is desirable for the long irons to have cavity back configurations. Muscle back clubs tend to have relatively small sweet spots, higher centers of gravity, and lower inertia about shaft axis 18. If struck correctly, muscle back clubs often yield greater overall performance or workability due to the mass (or muscle) behind the sweet spot, but are more difficult to hit accurately by the average golfer due to the smaller sweet spot. As short irons tend to be easier to hit true for the average golfer, but workability can be lacking, it is desirable for the short irons to have muscle back configurations.

According to one aspect of the present invention, the performance continuum of the set is maximized by gradually transforming the configuration of rear face 20 from a predominantly cavity back in the longest iron to a muscle back in the shortest iron.

Referring now to FIGS. 2–19, the configuration of rear face 20 of the individual club heads 10 progressing through an inventive set of clubs is presented. Table 1 details exemplary face area, exemplary offset, exemplary body length, and exemplary loft angle as the set progresses from the long irons to the short irons.

TABLE 1

| Exemplary Club Parameters | | | | | | |
|---|---|---|---|---|---|---|
| Iron Number | Loft Angle (degrees) | Cavity Volume ($cc^3$) | Face Area ($in^2$) | Offset (in) | Top Line Width (in) | Center Sole Width (in) |
| 2 | 19 | 8.10 | 4.88 | 0.15 | 0.245 | 0.720 |
| 3 | 22 | 7.52 | 4.92 | 0.14 | 0.237 | 0.705 |
| 4 | 25 | 6.59 | 4.96 | 0.13 | 0.229 | 0.690 |
| 5 | 28 | 5.61 | 4.99 | 0.121 | 0.221 | 0.675 |
| 6 | 32 | 4.49 | 5.03 | 0.11 | 0.213 | 0.660 |
| 7 | 36 | 3.62 | 5.06 | 0.099 | 0.205 | 0.645 |
| 8 | 40 | NA | 5.11 | 0.09 | 0.197 | 0.630 |
| 9 | 44 | NA | 5.17 | 0.084 | 0.189 | 0.615 |
| PW | 48 | NA | 5.23 | 0.08 | 0.181 | 0.600 |

Figure 2:
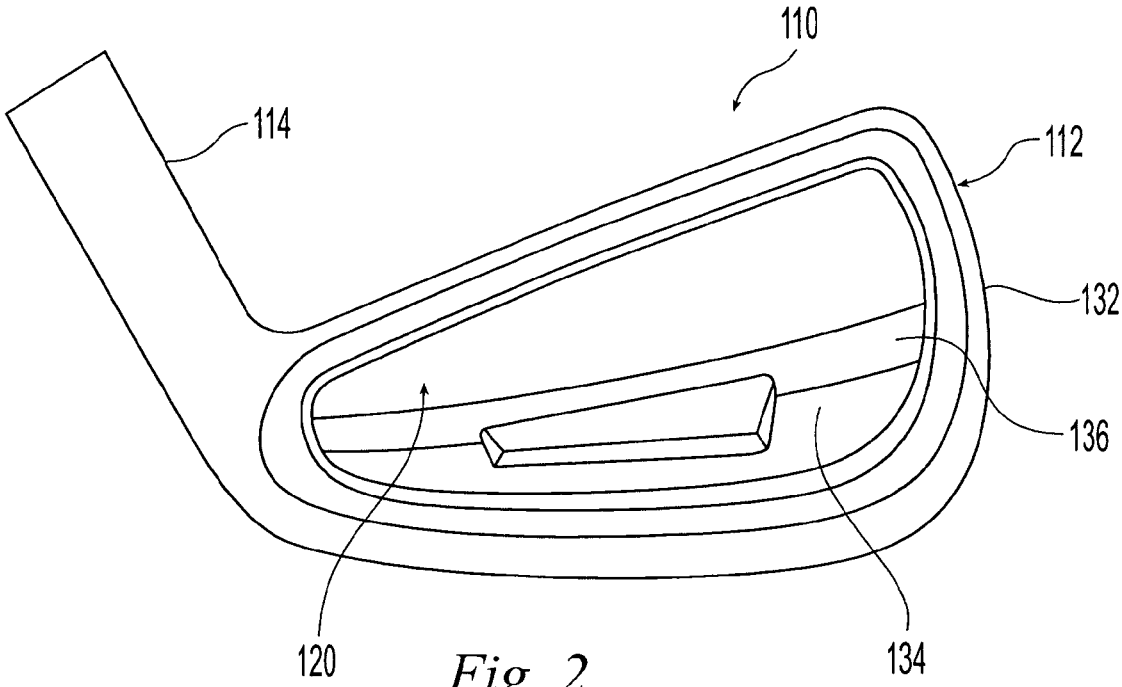
FIG. 2 shows a planar view of a rear face of a 2-iron of a club set according to the present invention.
Figure 3:
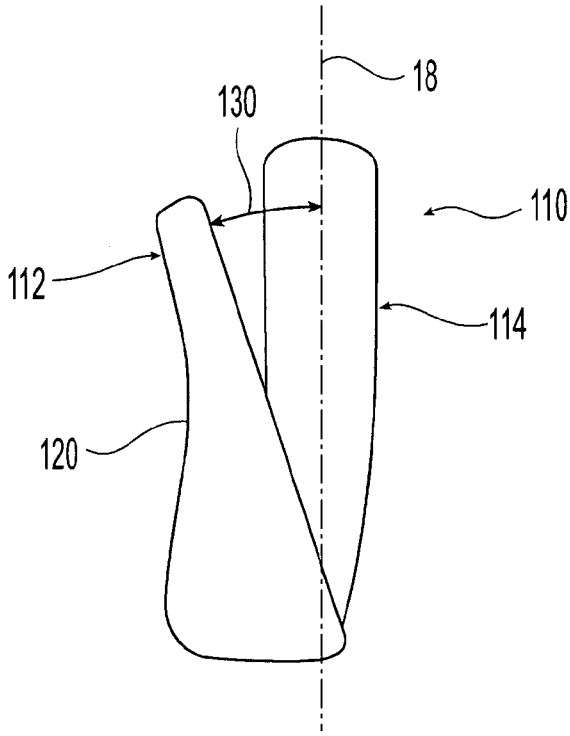
FIG. 3 shows a toe view of the club of FIG. 2.

FIG. 2 shows a club head 110 of a 2-iron, using conventional numbering, or of the longest iron. Rear face 120 of body 112 is characterized by a cavity 134 having a small ridge 136 extending only across the length of cavity 134. The mass of rear face 120 has been removed to a perimeter 132 to produce a cavity back club. As such, the attributes of cavity back designs dominate the performance of club head 110. FIG. 3 shows a toe view of club head 110 to more readily show the relatively low loft angle 130 of about 19 degrees. Furthermore, FIG. 3 shows more clearly that ridge 136 does not extend past perimeter 132.

Figure 4:
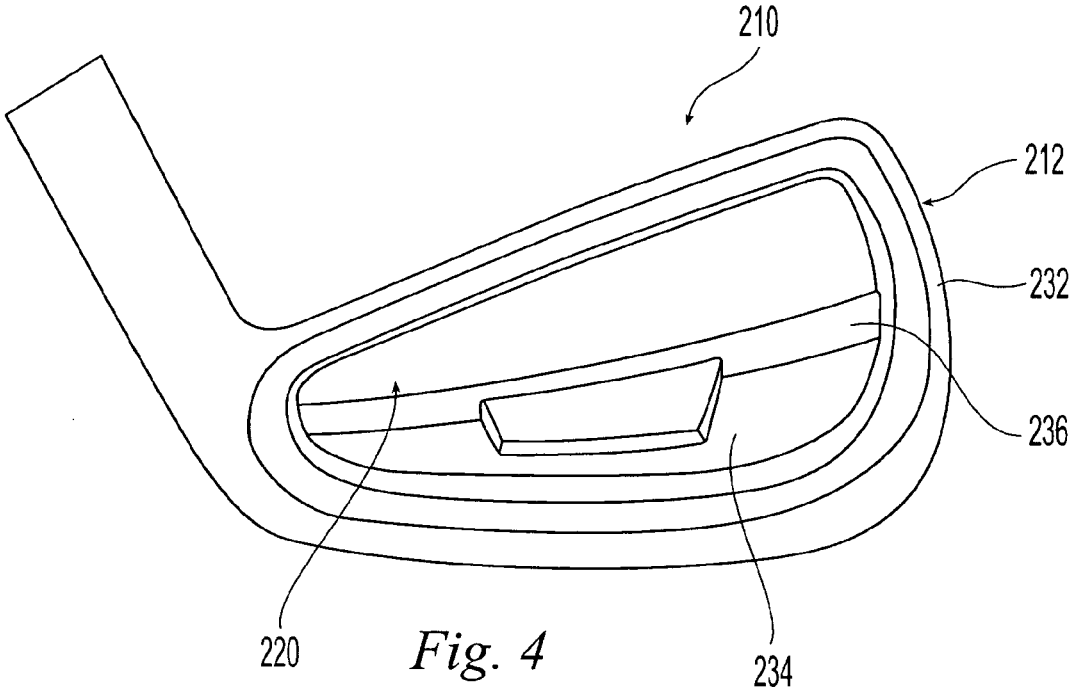
FIG. 4 shows a planar view of a rear face of a 3-iron of a club set according to the present invention.
Figure 5:
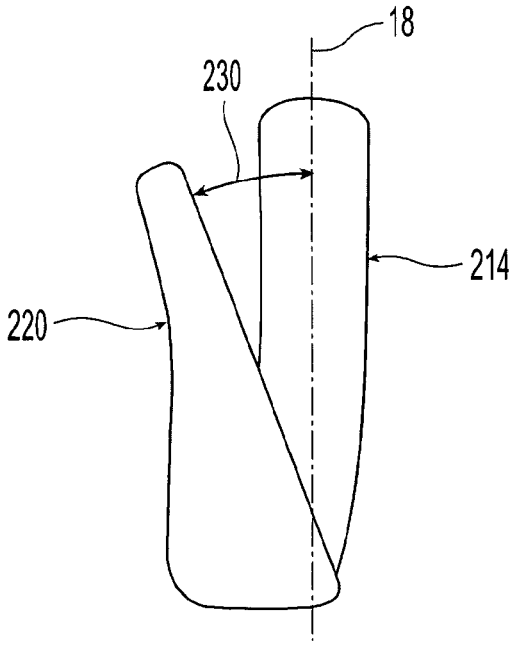
FIG. 5 shows a toe view of the club of FIG. 4.

FIG. 4 shows a club head 210 of a 3-iron or a long iron. Rear face 220 of body 212 is also characterized by a cavity 234 surrounded by a perimeter 232 containing much of the mass of rear face 220. Perimeter 232 is wider than perimeter 132 of the 2-iron of FIG. 2. In other words, cavity 234 is effectively smaller than cavity 134 of the 2-iron. A ridge 236, similar to ridge 136 as described above, is also included on rear face 220. However, the cavity back performance attributes still dominate. As seen in FIG. 5, a loft angle 230 of about 22 degrees is greater than loft angle 130 of the 2-iron. Also, FIG. 5 clearly shows that ridge 236 does not extend past perimeter 232.

Figure 6:
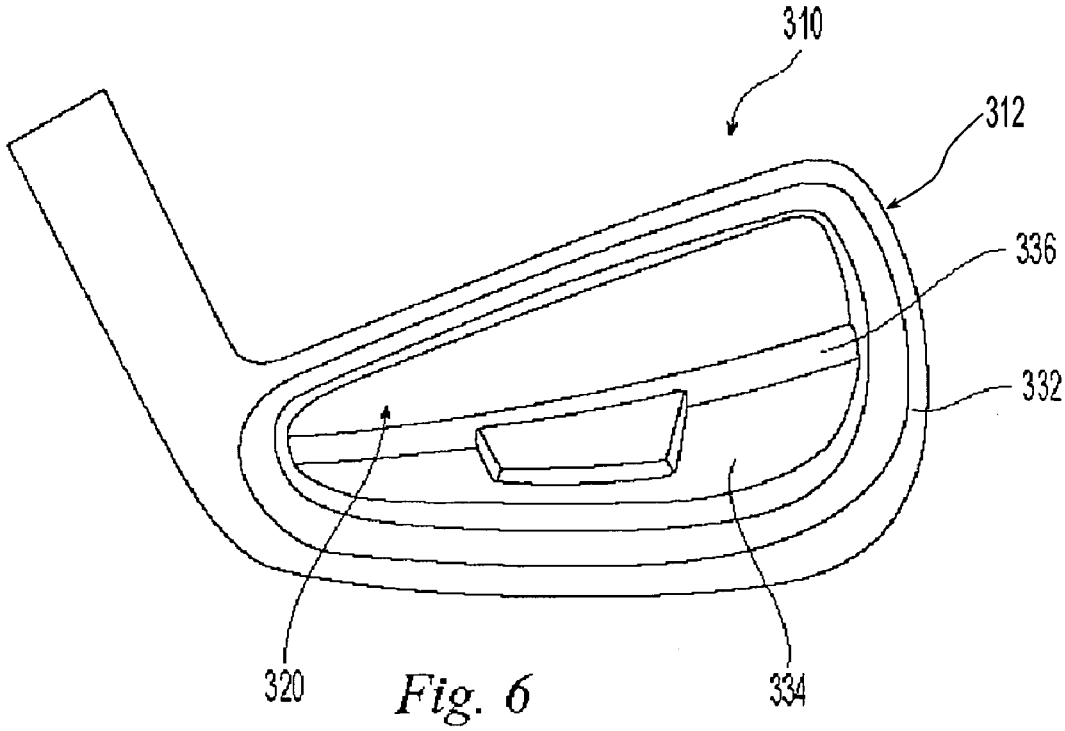
FIG. 6 shows a toe view of a rear face of a 4-iron of a club set according to the present invention.
Figure 7:
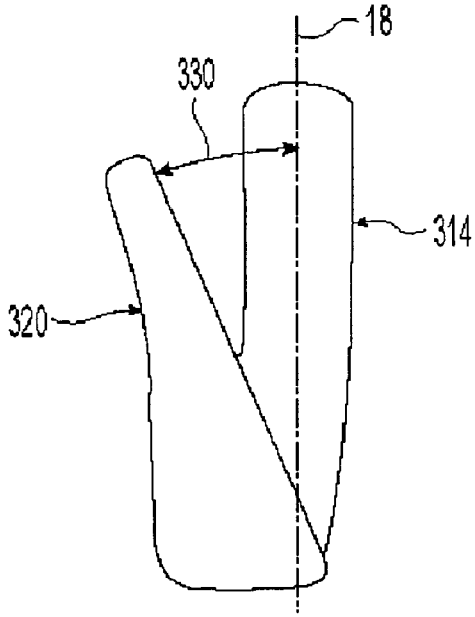
FIG. 7 shows a toe view of the club of FIG. 6.

FIG. 6 shows a club head 310 of a 4-iron or a mid-range iron. A rear face 320 of a body 312 is also characterized by a cavity 334 surrounded by a perimeter 332. Perimeter 332 is wider than perimeter 232 of the 3-iron of FIG. 4. In other words, cavity 334 is effectively smaller than cavity 234 of the 3-iron. Also, a ridge 336, similar to ridge 136 as described above, is also included on rear face 320. Additionally, as shown in Table 1, the face thickness of body 312 is thicker than the face thickness of body 212 of the 3-iron. As a result, cavity 334 is more shallow than cavity 234 of the 3-iron, resulting in an even smaller overall cavity volume for cavity 334. Therefore, while cavity back performance characteristics still dominate the behavior of club head 310, the attributes of muscle back configurations are being introduced into the overall performance of club head 310. As seen in FIG. 7, a loft angle 330 of about 25 degrees is greater than loft angle 230 of the 3-iron. Also, FIG. 7 clearly shows that ridge 336 does not extend past perimeter 332.

Figure 8:
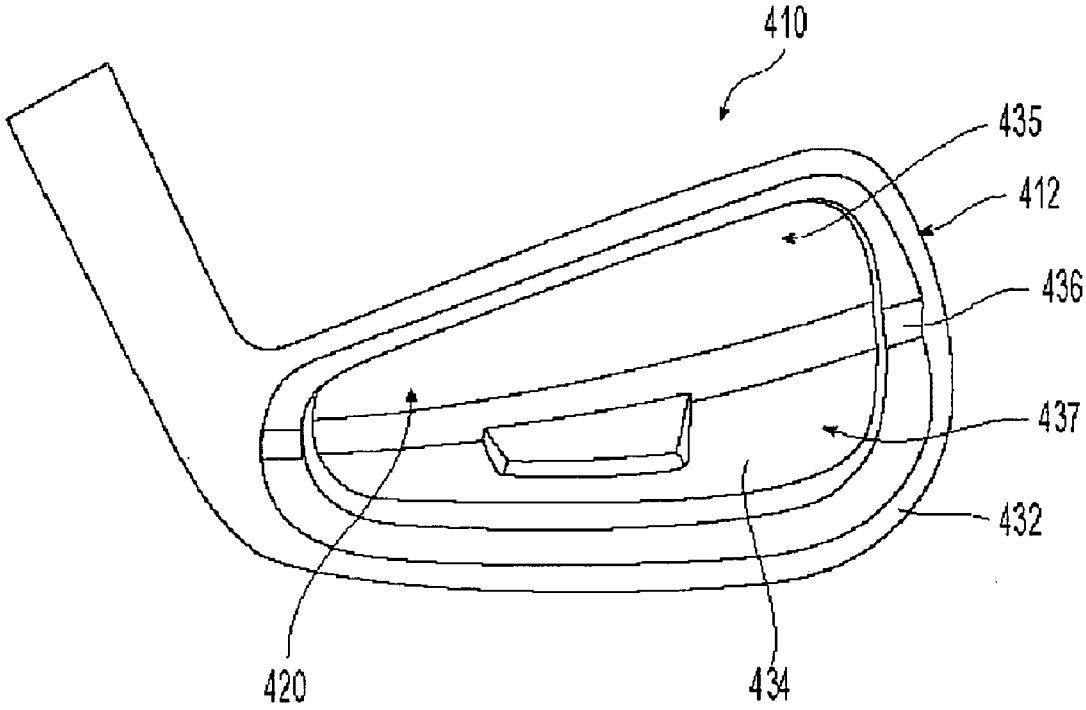
FIG. 8 shows a planar view of a rear face of a 5-iron of a club set according to the present invention.
Figure 9:
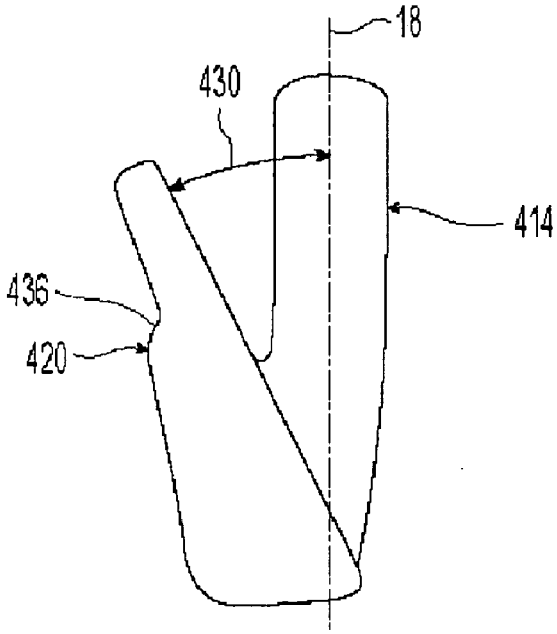
FIG. 9 shows a toe view of the club of FIG. 8.

FIG. 8 shows a club head 410 of a 5-iron or a mid-range iron. A rear face 420 is also characterized by a cavity 434 surrounded by a perimeter 432. However, rear face 420 has a transitional configuration, sharing certain aspects of both the traditional cavity back and the traditional muscle back. As opposed to a true cavity back configuration, body 412 has two substantially different thicknesses: a thinner top portion 435 and a thicker bottom portion 437 connected by a transitional portion 436. Transitional portion 436 extends the entire length of body 412, as can be more clearly seen in profile in FIG. 9. In other words, a transitional club head such as club head 410 may be defined as having transitional portion 436 on perimeter 432. As such, the performance characteristics of cavity back designs and muscle back designs are both present, with neither configuration dominating the overall performance of club head 410. FIG. 9 also shows a loft angle 430 of about 28 degrees, or higher than loft angle 330.

Figure 10:
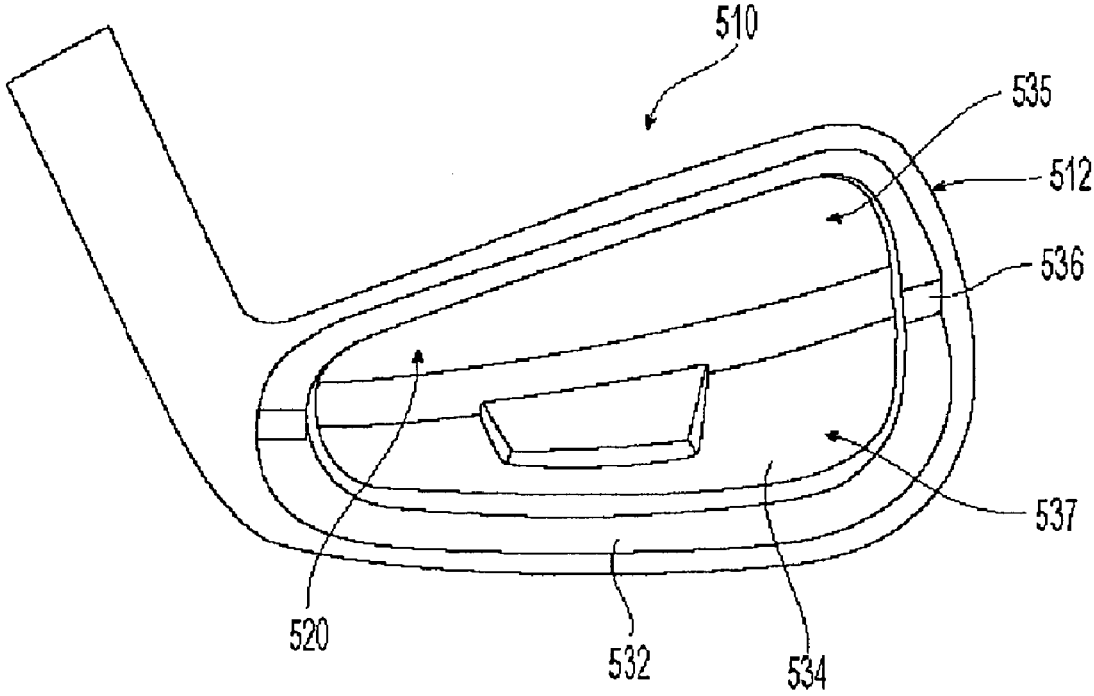
FIG. 10 shows a planar view of a rear face of a 6-iron of a club set according to the present invention.
Figure 11:
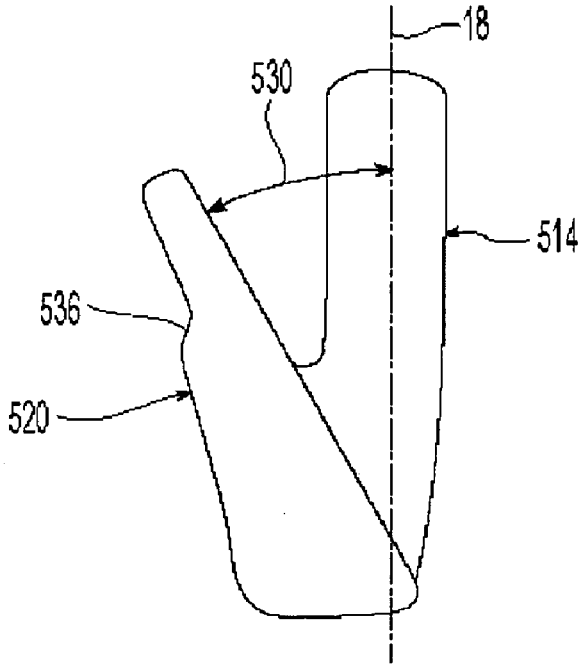
FIG. 11 shows a toe view of the club of FIG. 10.

FIG. 10 shows a club head 510 of a 6-iron or a mid-range iron. A rear face 520 of a body 512 is similar to that of the 5-iron shown in FIG. 8: a transitional club. A relatively shallow cavity 534 is outlined by a perimeter 532. An upper body portion 535 transitions to a thicker lower body portion 537 through a transitional portion 536 and transition portion 536 is present on perimeter 532. This variation can also be seen in profile in FIG. 11. FIG. 11 also shows a loft angle 530 of about 32 degrees, which is higher than loft angle 430.

Figure 12:
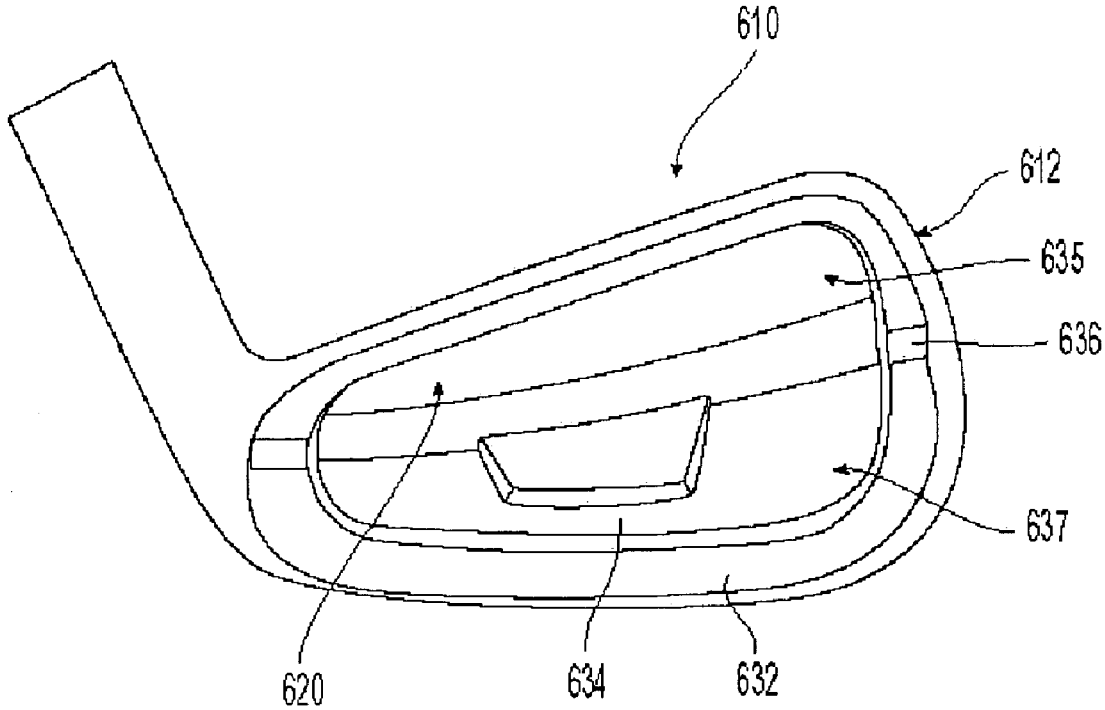
FIG. 12 shows a planar view of a rear face of a 7-iron of a club set according to the present invention.
Figure 13:
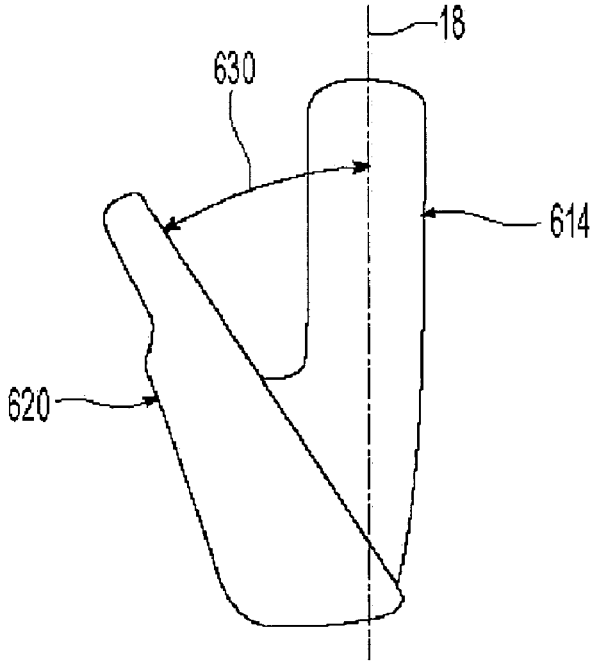
FIG. 13 shows a toe view of the club of FIG. 12.

FIG. 12 shows a club head 610 of a 7-iron or a mid-range iron. A rear face 620 of a body 612 is similar to that of the 6-iron shown in FIG. 10, a transitional club. However, here, a cavity 634 is significantly shallow with a perimeter 632 having only a slightly greater thickness than cavity 634. Club head 610 has an upper body portion 635 transitioning to a thicker lower body portion 637 through a transitional portion 636, and transitional portion 636 is present on perimeter 632. The varying thicknesses are clearly seen in the toe profile as shown in FIG. 13. Consequently, the muscle back performance characteristics will tend to overshadow the performance of this club. FIG. 13 shows a loft angle 630 of about 36 degrees, which is higher than loft angle 530.

Figure 14:
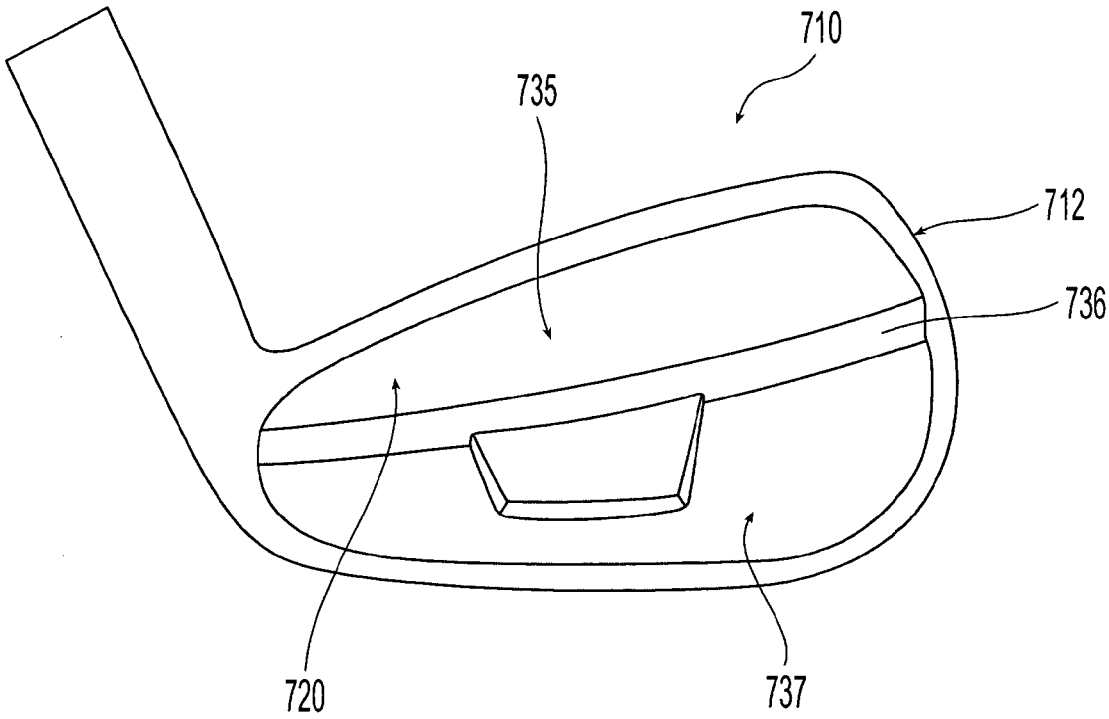
FIG. 14 shows a planar view of a rear face of an 8-iron of a club set according to the present invention.
Figure 15:
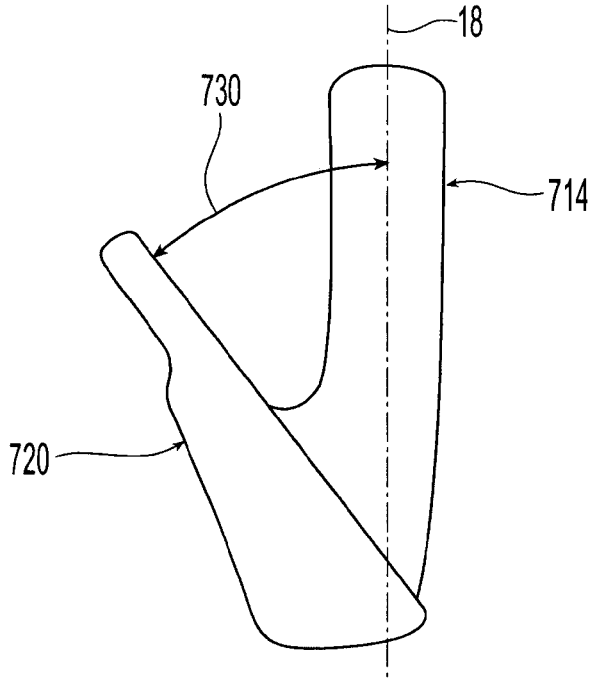
FIG. 15 shows a toe view of the club of FIG. 14.

FIG. 14 shows a club head 710 of an 8-iron or a short iron. A rear face 720 of a body 712 has a traditional muscle back configuration. In other words, no cavity defined by a perimeter is present, with a resultant smaller sweet spot than either the cavity back or transitional clubs discussed above. An upper body portion 735 is thinner than a lower body portion 737. A transition portion 736 connects the two portions 735, 737. As shown in FIG. 15, a loft angle 730 of about 40 degrees is higher than loft angle 630.

Figure 16:
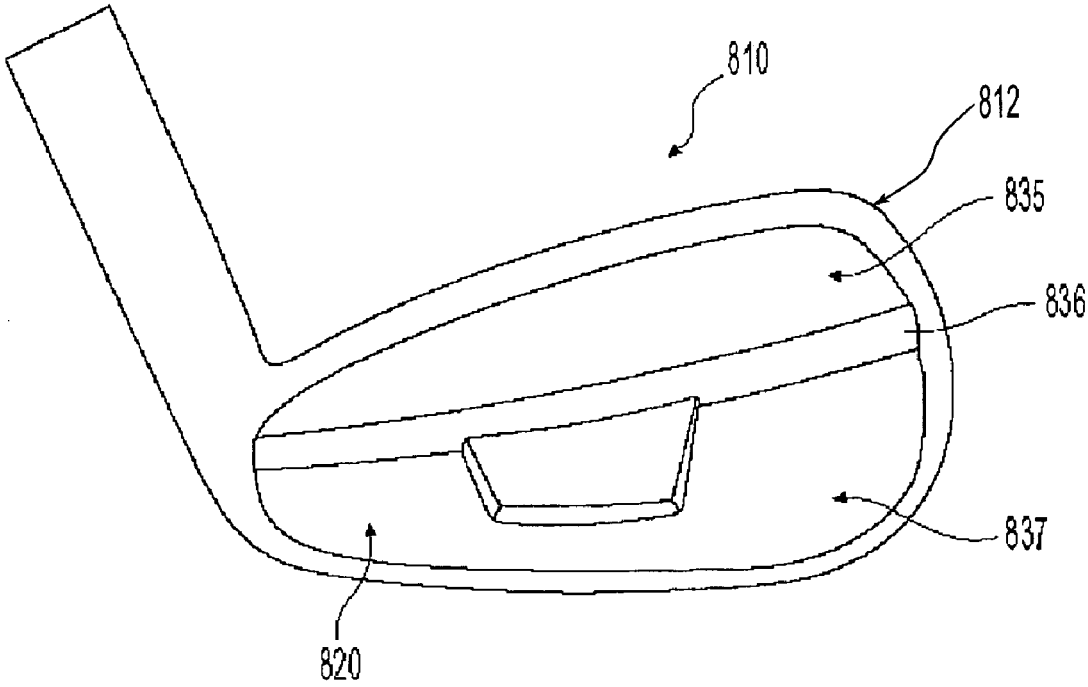
FIG. 16 shows a planar view of a rear face of a 9-iron of a club set according to the present invention.
Figure 17:
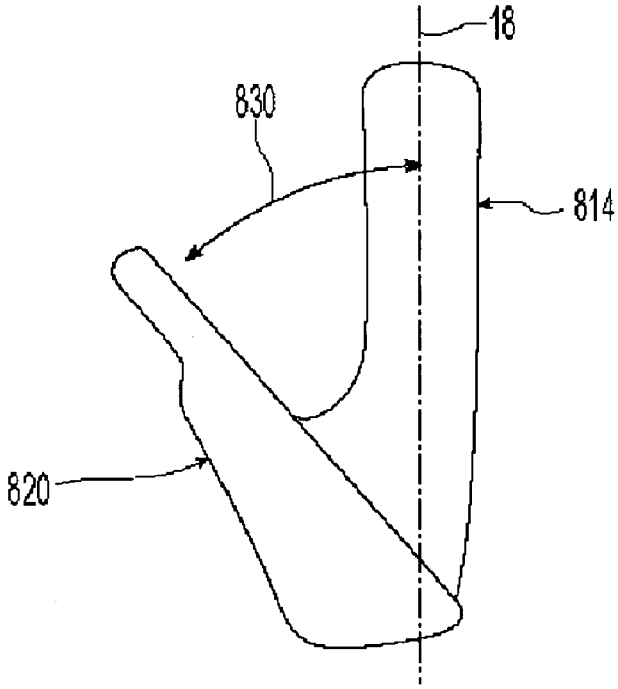
FIG. 17 shows a toe view of the club of FIG. 16.

FIG. 16 shows a club head 810 of a 9-iron or a short iron. A rear face 820 of a body 812 is also a traditional muscle back configuration like the 8-iron shown in FIG. 14. However, in rear face 820, a thinner upper body portion 835 is shorter than upper body portion 735 of the 8-iron. Similarly, thicker lower body portion 837 dominates more of body 812. As shown in FIG. 17, a loft angle 830 of about 44 degrees is higher than loft angle 730.

Figure 18:
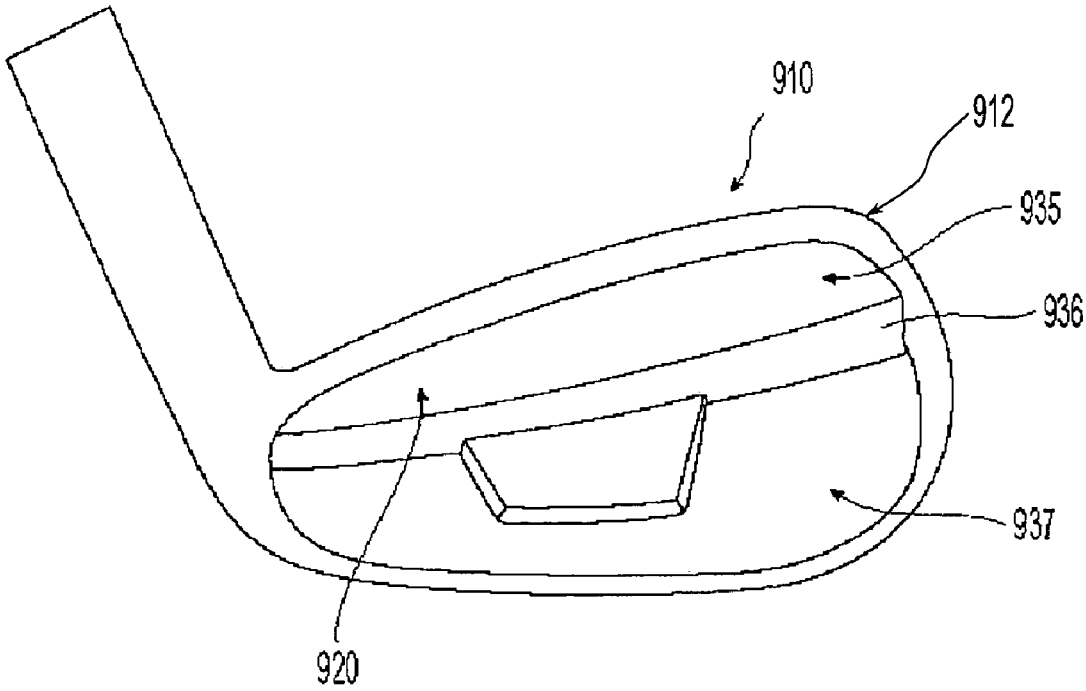
FIG. 18 shows a planar view of a rear face of a pitching wedge of a club set according to the present invention.
Figure 19:
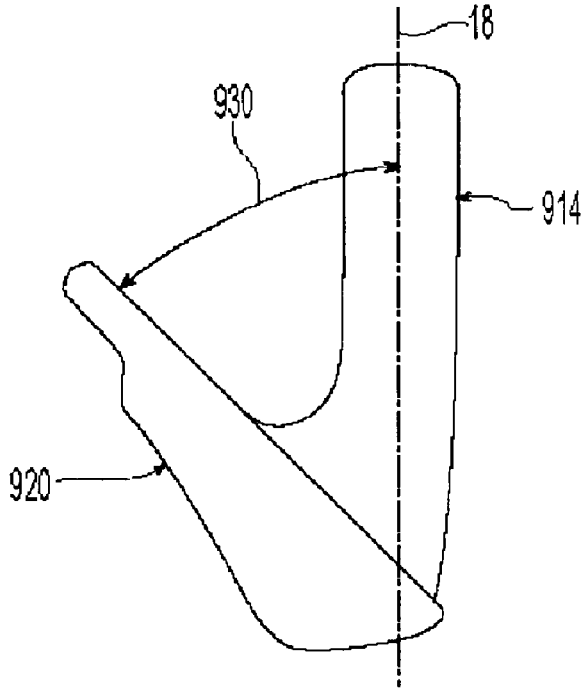
FIG. 19 shows a toe view of the club of FIG. 18.

FIG. 18 shows a club head 910 of a pitching wedge or the shortest iron. A rear face 920 of a body 912 is also a traditional muscle back configuration like the 9-iron shown in FIG. 16, with a thinner upper body portion 935 transitioning through a transitional portion 936 to a thicker lower body portion 937. As is best shown in FIG. 19, upper body portion 935 of the pitching wedge is even shorter than upper body portion 835. As shown in FIG. 19, a loft angle 930 of about 48 degrees is even higher than loft angle 830.

This systematic transition from cavity back clubs in the long irons of the set through transitional cavity-muscle backs in the mid-range irons to pure muscle back clubs in the short irons allows for a smoother performance continuum for the set taken as a whole. The long irons are made easier to hit correctly due to the cavity back design, and the short irons have improved performance due to the muscle back design. As is known in the art, when the center of gravity is below and behind the geometric center of the hitting face, the club can launch the golf ball to higher trajectory and longer flight distance. Also, Table 2 shows how exemplary centers of gravity of the bodies systematically increase through the set with the systematic transition of the exemplary set parameters as shown in Table 1.

TABLE 2

Center of Gravity and Inertial Moments for Inventive Set

| Iron Number | CG from Ground | Moment of Inertia ($I_{xx}$) (Kg-mm$^2$) | Moment of Inertia ($I_{yy}$) (Kg-mm$^2$) | Moment of Inertia ($I_{sa}$) (Kg-mm$^2$) |
|---|---|---|---|---|
| 2 | 17.00 | 46.5 | 211 | 453 |
| 3 | 17.20 | 47.0 | 211 | 464 |
| 4 | 17.40 | 48.7 | 211 | 477 |
| 5 | 17.60 | 49.0 | 214 | 498 |
| 6 | 17.80 | 50.0 | 217 | 511 |
| 7 | 18.00 | 51.5 | 221 | 529 |
| 8 | 18.20 | 60.4 | 225 | 534 |
| 9 | 18.40 | 64.0 | 231 | 545 |
| PW | 18.60 | 65.9 | 234 | 561 |

The center of gravity is measured from the ground while the club head is in the address position, which is the position in which a golfer places the club with the sole of the club on the ground prior to beginning a swing. As will be understood by those in the art, the location of the center of gravity may be altered through the set by other means, such as by including a dense insert, as described in co-owned, co-pending application Ser. No. 10/911,422 filed on Aug. 8, 2004, the disclosure of which is incorporated herein by reference, or by otherwise altering the thickness or materials of hitting face 16 as described in U.S. Pat. No. 6,605,007, the disclosure of which is incorporated herein by reference.

Rotational moment of inertia ("inertia") in golf clubs is well known in art, and is fully discussed in many references, including U.S. Pat. No. 4,420,156, which is incorporated herein by reference in its entirety. When the inertia is too low, the club head tends to rotate excessively from off-center hits. Higher inertia indicates higher rotational mass and less rotation from off-center hits, thereby allowing off-center hits to fly farther and closer to the intended path. Inertia is measured about a vertical axis going through the center of gravity of the club head ($I_{yy}$), and about a horizontal axis going through the center of gravity (CG) of the club head ($I_{xx}$). The tendency of the club head to rotate around the y-axis through the CG indicates the amount of rotation that an off-center hit away from the y-axis causes. Similarly, the tendency of the club head to rotate in the around the x-axis through the CG indicates the amount of rotation that an off-center hit away from the x-axis through the CG causes. Most off-center hits cause a tendency to rotate around both x and y axes. High $I_{xx}$ and $I_{yy}$ reduce the tendency to rotate and provide more forgiveness to off-center hits.

Inertia is also measured about the shaft axis ($I_{sa}$). First, the face of the club is set in the address position, then the face is squared and the loft angle and the lie angle are set before measurements are taken. Any golf ball hit has a tendency to cause the club head to rotate around the shaft axis. An off-center hit toward the toe would produce the highest tendency to rotate about the shaft axis, and an off-center hit toward the heel causes the lowest. High $I_{sa}$ reduces the tendency to rotate and provides more control of the hitting face.

Club heads 110–910 may be made from any material known in the art and by any method known in the art. Preferably, however, club head 110 is forged from stainless steel or carbon steel with chrome plating. Further discussion of this and other manufacturing methods and appropriate materials may be found in co-owned, co-pending application Ser. No. 10/640,537 filed on Aug. 13, 2003, the disclosure of which is incorporated herein by reference.

Referring again to Table 1, FIGS. 20, 21 graphically reflect how exemplary parameters may be systematically progressed through the set from the long irons to the short irons to yield maximum performance results from the set. The other parameters in Table 1 and those in Table 2 can also be graphically represented.

As in many typical sets, loft angle 30 increases as the set progresses from the long irons (2, 3, 4) to the short irons (8, 9, PW). For the long irons, loft angle 30 varies linearly: approximately a three-degree increase. Similarly, for the short irons, loft angle 30 varies linearly: approximately a four-degree increase. Other variations of loft angle 30 are within the scope of the present invention, and the choice of loft angle 30 may depend upon various other design considerations, such as the choice of material and aesthetics.

Figure 20:
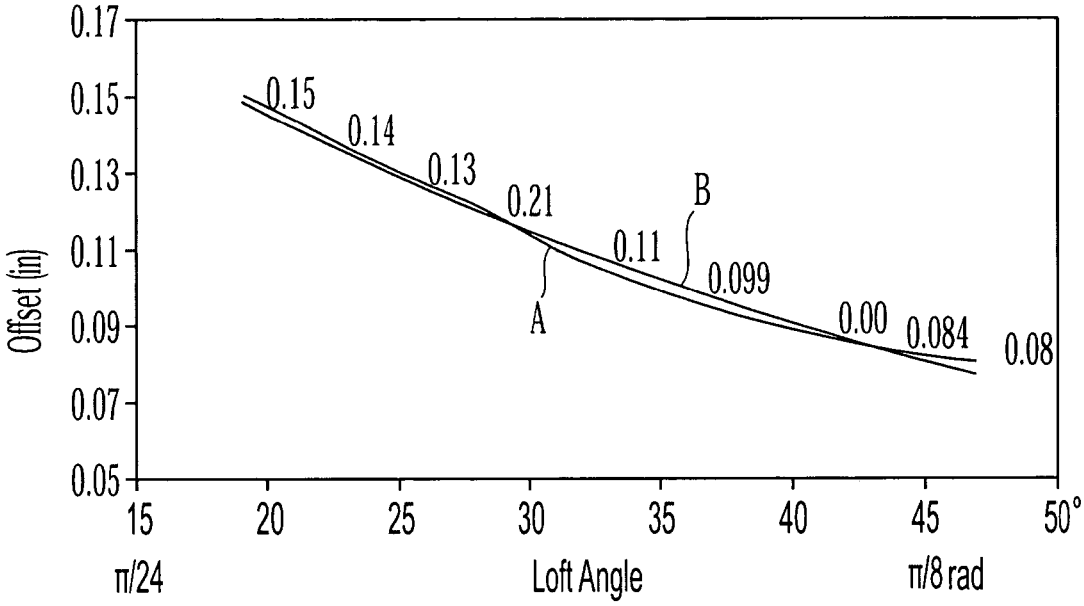
FIG. 20 is a graph showing club offset versus club loft angle for a club set according to the present invention.

FIG. 20 shows that offset 34 decreases as loft angle 30 increases, where loft angle 30 is shown on the graph in both degrees and radians. In other words, offset 34 decreases as the set progresses from the long irons to the short irons according to curve A. This curve can be described using an equation. A best fit polynomial equation, curve B, is preferably used to reflect the curve of the data in FIG. 20. In this case, the offset varies with loft angle generally according to the following equation obtained by regression:

$$O=0.2327*e^{-0.0236LAdeg} \quad \text{Eq. 1}$$

where O is the offset in inches and $LA_{deg}$ is the loft angle in degrees. The coefficient of determination ($R^2$) for this equation is approximately 0.9903. Coefficient of determination is a statistical value that is commonly used to determine how well a regression fits the data. This coefficient is expressed as a percentage or an equivalent decimal and implies the percentage of data accounted for in the regression.

Additionally, a linear equation can also be used. By best-fitting a line using the data and the standard regression or least squares method, the offset varies with loft angle generally according to the following equation:

$$O=-0.0025*LA+0.2 \quad \text{Eq. 2}$$

where O is the offset in inches and LA is the loft angle in degrees. $R^2$ for Eq. 2 is approximately 0.9999. Loft angle may also be measured in radians ($LA_{rad}$), although doing so changes the equation slightly:

$$O=-0.13*LA_{rad}+0.19 \quad \text{Eq. 3}$$

$R^2$ for Eq. 3 is approximately 0.9901. As such, the clubs of the exemplary set should fit one of Eqs. 1, 2 or 3 within a design tolerance of approximately ±10%. The design tolerances are meant to account for aesthetics and other design criteria. For example, if a loft angle of 20 degrees is typical for a 2-iron in a company's design scheme, then the calculated offset of the 2-iron using Eq. 2 is approximately 0.15 in. ±0.02 in to account for $R^2$ and ± an additional 0.015 in to account for design tolerances. Another way to use these equations and account for tolerances is to multiply the result of the regressed equation by a factor α that takes into account both $R^2$ and the design tolerance. For example, Eq. 2 with factor α becomes:

$$O=\alpha*(-0.0025*LA+0.2) \quad \text{Eq. 2}\alpha$$

where a ranges from about 0.89 to about 1.11 to account for an $R^2$ of about 0.9999 and a design tolerance of approximately ±10%. For the rest of the clubs of the set to progress appropriately according to the present invention in this example, then the offsets of the other clubs of the set must also fit this equation within tolerances.

Figure 21:
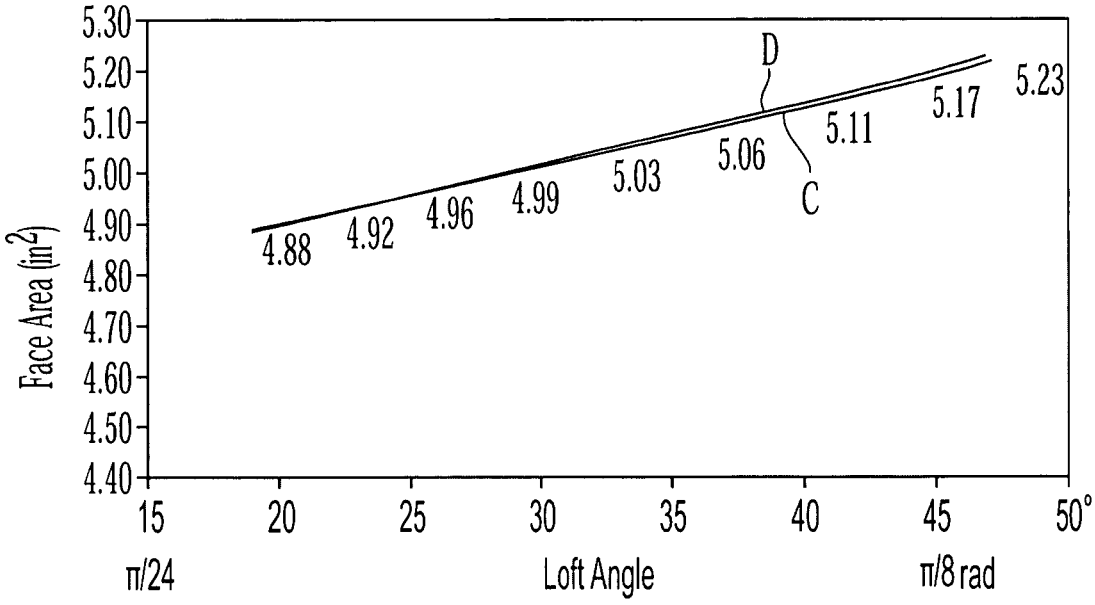
FIG. 21 is a graph showing club face area versus club loft angle for a club set according to the present invention.

FIG. 21 shows that face area increases according to curve C as loft angle 30 increases, where loft angle 30 is shown on the graph in both degrees and radians. By again best-fitting a line, curve D, using the data shown in Table 1 and the standard regression or least squares method, the face area varies with loft angle generally according to the following equation:

$$FA=0.01*LA_{deg}+4.66 \quad \text{Eq. 4}$$

where FA is the face area in $in^2$. $R^2$ for Eq. 4 is approximately 0.9974. Loft angle may also be measured in radians, although doing so changes the equation slightly:

$$FA=0.61*LA_{rad}+4.69 \quad \text{Eq. 5}$$

$R^2$ for Eq. 5 is approximately 0.9999. As such, the clubs of the exemplary set should fit one of Eq. 4 or Eq. 5 with a preferred design tolerance, however, of approximately ±15%. For example, if a loft angle of 20 degrees is typical for a 2-iron in a company's design scheme, then the calculated face area of the 2-iron using Eq. 5 is 4.9 $in^2$±0.1 $in^2$ to account for $R^2$ and ± additional 0.735 $in^2$ to account for design tolerances. In one embodiment, the a factor for these equations about 0.98 to about 1.02 and is preferably 1.

Figure 22:
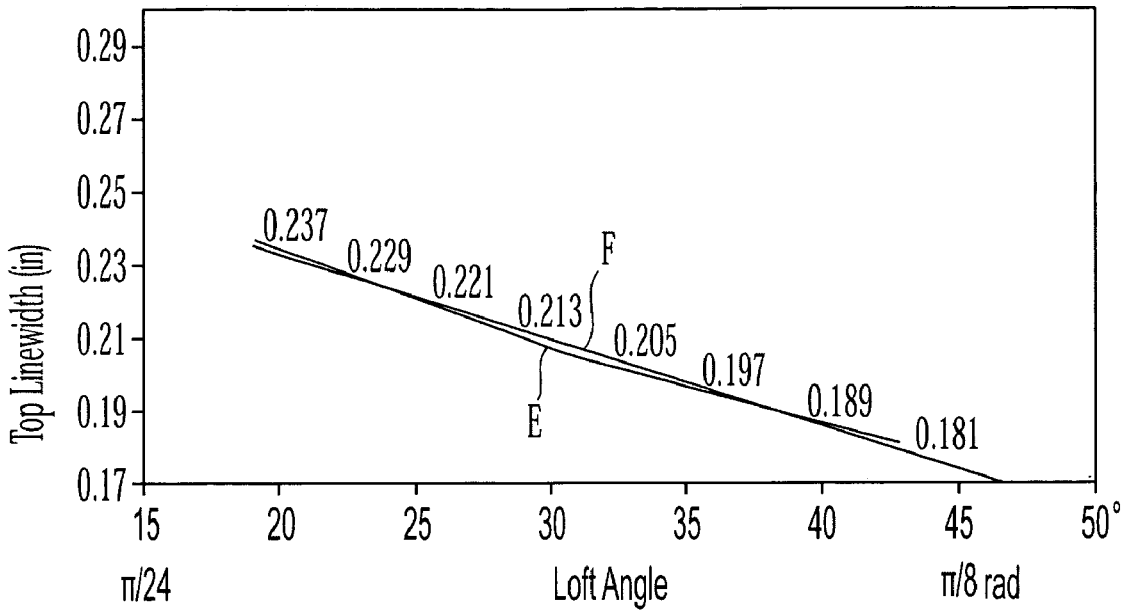
FIG. 22 is a graph showing top line width versus club loft angle for a club set according to the present invention.

FIG. 22 shows with curve E yet another parameter, the top line width, as it systematically varies with loft angle through the set. Using the same methodology as noted above, the best fit line, curve F, for this data is:

$$TLW=-0.0023*LA_{deg}+0.3 \quad \text{Eq. 6}$$

where TLW is the top line width in inches. $R^2$ for Eq. 6 is approximately 0.9999, and the design tolerance is preferably approximately ±20%. In one embodiment, the a factor for these equations ranges from about 0.75 to about 1.25 and is preferably 1.

Figure 23:
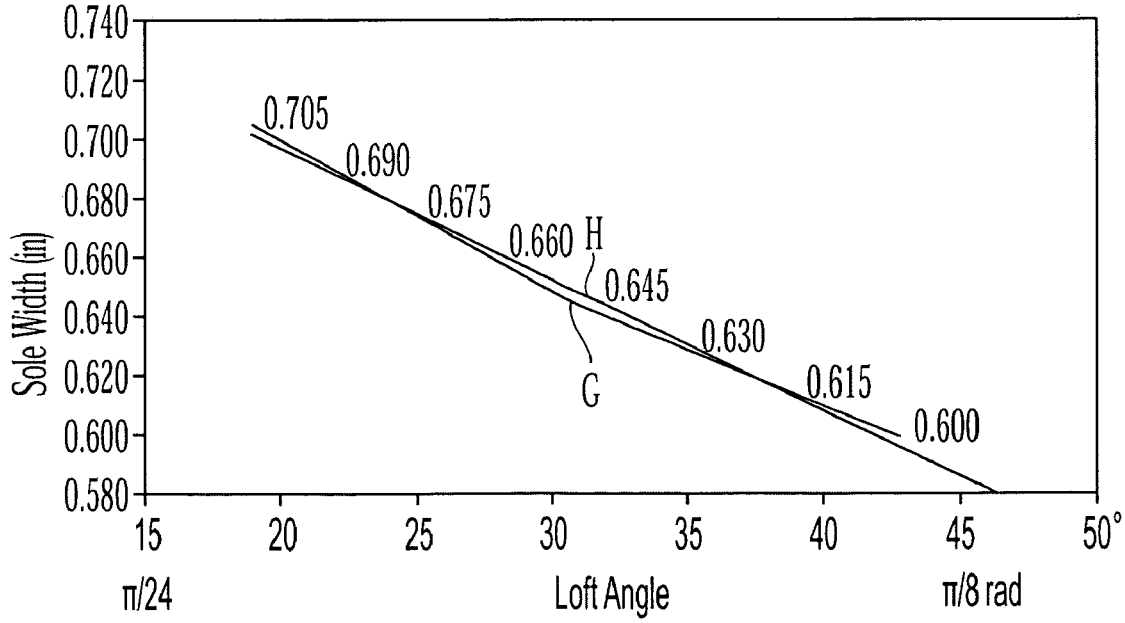
FIG. 23 is a graph showing sole width versus club loft angle for a club set according to the present invention.

FIG. 23 shows with curve G how yet another parameter, the sole width, varies with loft angle through a set of clubs. Using the same methodology noted above, the best fit line, curve H, for this data is given by the following equation:

$$SW=-0.0044*LA_{deg}+0.79 \quad \text{Eq. 7}$$

where SW is the sole width in inches. $R^2$ for Eq. 7 is about 0.9999, and the design tolerance is preferably approximately ±20%. In one embodiment, the α factor for these equations ranges from about 0.75 to about 1.25 and is preferably 1.

Additionally, the systematic variation of a parameter through the set may extend to only a portion of the set. For example, as listed in Table 1 and as shown in FIGS. 2, 4, 6, 8, 10, and 12, the volume of the cavity (cavity 234, 334, 434, 534, and 634, respectively) decreases systematically through the set. However, the short irons are muscle back clubs having substantially no cavity. Therefore, the following equations were derived using a standard regression method for the cavity volume as a function of loft angle using the data from the example set as listed in Table 1, which equation preferably applies only to clubs 2–7 of the set:

$$CV=-0.29*LA_{deg}+13.85 \quad \text{Eq. 8}$$

where CV is the cavity volume in cubic centimeters and LA is the loft angle in degrees. $R^2$ for this equation is approximately 0.9872, and the preferred design tolerance is ±20%. If the loft angle is measured in radians, the equation is slightly different:

$$CV=-16.88*LA_{rad}+13.85 \quad \text{Eq. 9}$$

$R^2$ for Eq. 9 is about 0.9973. In one embodiment, the α factor for these equations ranges from about 0.75 to about 1.25 and is preferably 1. It will be obvious to those in the art that applying the equations for systematically varying design parameters to only a portion of the set may be extended to all design parameters and is not just limited to cavity volume.

Similar equations may be produced for any desired parameter. Additionally, equations may also be produced for club characteristics such as center of gravity and moments of inertia. Once a curve is produced for the set using these parameters, other design characteristics such as face area and sole width may be extrapolated from this curve. In other words, for example, the face area of a club head within a set may not fit the curve described by Eq. 4 or Eq. 5, but the center of gravity of that club will fit the appropriate curve as described below due to the overall effects of the design parameters. For example, while not shown graphically, the following equation was developed using the standard regression method for the location of the center of gravity measured from ground as a function of loft angle using the data from the example set as listed in Table 1:

$$CG_y=0.05*LA_{deg}+16.14 \quad \text{Eq. 10}$$

where $CG_y$ is the location of the center of gravity from as measured in inches from the ground while the club head is in the address position. $R^2$ for Eq. 10 is approximately 1. Loft angle may also be measured in radians, which changes the equation slightly to the following:

$$CG_y=3.04*LA_{rad}+16.1 \quad \text{Eq. 11}$$

$R^2$ for Eq. 11 is approximately 0.9999. As such, the clubs of the exemplary set should fit one of Eq. 10 or Eq. 11 within a preferred design tolerance of approximately ±20%. In one embodiment, the α factor for these equations ranges from about 0.75 to about 1.25 and is preferably 1. In application, if a loft angle of 20 degrees is typical for a 2-iron in a company's design scheme, then the calculated center of gravity of the 2-iron using Eq. 10 is approximately 17.04 in.±0.34 to account for $R^2$ and ± an additional 3.4 in to account for design tolerances.

Similar equations may also be developed for the moments of inertia listed in Table 2, as shown below:

$$I_{xx}=0.75LA_{deg}+29.56 \quad \text{Eq. 12}$$

$$I_{xx}=43.02LA_{rad}+29.56 \quad \text{Eq. 13}$$

where $I_{xx}$ is the moment of inertia about a horizontal axis that passes through the center of gravity of the face. $R^2$ is about 0.9999 for Eq. 12 and about 0.9955 for Eq. 13 with both equations having a preferred design tolerance of about ±15%. In one embodiment, the a factor for these equations ranges from about 0.8 to about 1.2 and is preferably 1.

$$I_{yy}=0.9*LA_{deg}+190.48 \quad \text{Eq. 14}$$

$$I_{yy}=51.69*LA_{rad}+190.48 \quad \text{Eq. 15}$$

where $I_{yy}$ is the moment of inertia about a vertical axis that passes through the center of gravity of the hitting face. $R^2$ is about 1 for Eq. 14 and about 0.9998 for Eq. 15 with both equations having a preferred design tolerance of about ±15%. In one embodiment, the α factor for these equations ranges from about 0.8 to about 1.2 and is preferably 1.

$$I_{sa}=3.87*LA_{deg}+383.88 \quad \text{Eq. 16}$$

$$I_{sa}=221.46*LA_{rad}+383.88 \quad \text{Eq. 17}$$

where $I_{sa}$ is the moment of inertia of the club head about the shaft axis. $R^2$ is about 1 for Eq. 16 and about 0.9997 for Eq. 17 with both equations having a preferred design tolerance of about ±15%. In one embodiment, the a factor for these equations ranges from about 0.8 to about 1.2 and is preferably 1.

Other parameters may be varied systematically through the set, such as toe height, top angle, sole thickness, material alloy and/or hardness, insert type and hardness, face thickness and/or material, and coefficient of restitution. Groove geometry may be varied to affect spin performance, such as is discussed in U.S. Pat. No. 5,591,092, the disclosure of which is hereby incorporated by reference. Also, the depth of the center of gravity may also be varied through the set, as the depth of the center of gravity affects flight performance as disclosed in U.S. Pat. No. 6,290,607, the disclosure of which is hereby incorporated by reference. Additionally, the curves shown in FIGS. 20–23 and the equations are examples and may have any variation desirable for performance continuum throughout the set. In other words, the particular equations developed herein may be altered or adjusted so that a design parameter progresses in alternate ways than those described herein by adjusting the relationship between for example, the offset and the loft angle. The design tolerances discussed herein are preferences and may be adjusted to account for inter alia different materials and aesthetics.

While it is apparent that the illustrative embodiments of the invention disclosed herein fulfill the objectives stated above, it is appreciated that numerous modifications and other embodiments may be devised by those skilled in the art. Therefore, it will be understood that the appended claims are intended to cover all such modifications and embodiments, which would come within the spirit and scope of the present invention.

We claim:

1. A set of iron-type golf clubs comprising:

at least one cavity back club;

at least one muscle back club; and wherein the clubs are made from forged stainless steel and at least one club design parameter is systematically varied through the set, and wherein the set comprises at least three clubs, wherein a club head face area (FA) for each club is in accordance with $$FA=\alpha*(0.01*LA+4.71)$$

wherein LA is a loft angle measured in degrees, FA is face area measured in $in^2$, and α ranges from about 0.8 to about 1.2.

2. The set of clubs according to claim 1 further comprising at least one transitional club, wherein a transitional club head comprises a cavity defined on a rear face of the transitional club head and a ridge that extends from the cavity to the toe perimeter.

3. The set of clubs according to claim 1, wherein the clubs systematically transition from cavity back clubs in the long irons of the set to muscle back clubs in the short irons of the set.

4. The set of clubs according to claim 1, wherein the club design parameter is a function of a loft angle.

5. The set of clubs according to claim 4, wherein the club design parameter is selected from the group consisting of an offset, a face area, a top line width, a sole width, a center of gravity from ground, a depth of the center of gravity, a coefficient of restitution, a club head material a club head face thickness, a groove geometry, a cavity volume, a club head horizontal moment of inertia taken about a horizontal axis that passes through a hitting face center of gravity, a club head vertical moment of inertia taken about a vertical axis that passes through the hitting face center of gravity, and a club head shaft moment of inertia taken about a shaft axis.

6. The set of iron-type golf clubs according to claim 1 comprising at least three clubs, wherein an offset (O) for each club is in accordance with $$O=\alpha*(-0.0025*LA+0.2)$$

wherein LA is a loft angle measured in degrees, O is offset measured in inches, and α ranges from about 0.89 to about 1.11.

7. The set of clubs according to claim 6, wherein α is about 1.

8. The set of clubs according to claim 1, wherein α is about 1.

9. The set of iron-type golf clubs according to claim 1 comprising at least three clubs, wherein a club head top line width (TLW) is in accordance with $$TLW=\alpha*(-0.0023LA_{deg}+0.3)$$

wherein LA is a loft angle measured in degrees, TLW is top line width measured in inches and α ranges from about 0.75 to about 1.25.

10. The set clubs according to claim 9, wherein α is about 1.

11. The set of iron-type golf clubs according to claim 1 comprising at least three clubs, wherein a club head sole width (SW) is in accordance with $$SW=\alpha*(-0.0044LA+0.79)$$

wherein LA is a loft angle measured in degrees, SW is sole width measured in inches, and α ranges from about 0.75 to about 1.25.

12. The set of clubs according to claim 11, wherein α is about 1.

13. The set of iron-type golf clubs according to claim 1 comprising at least three clubs, wherein a club head cavity volume (CV) for a long iron or a mid-length iron is in accordance with $$CV=\alpha*(-0.29\ LA+13.85)$$

wherein LA is a loft angle measured in degrees, CV is cavity volume measured in cubic centimeters, and α ranges from about 0.75 to about 1.25.

14. The set of clubs according to claim 13, wherein α is about 1.

15. The set of iron-type golf clubs according to claim 1 comprising at least three clubs, wherein a club head moment of inertia about a horizontal axis that passes through a center of gravity of a club head hitting face is in accordance with $$I_{xx}=\alpha*(0.75LA+29.56)$$

wherein LA is a loft angle measured in degrees, $I_{xx}$ is the moment of inertia of the club head about a horizontal axis that passes through the center of gravity of the face, and α ranges from about 0.8 to about 1.2.

16. The set of clubs according to claim 15, wherein α is about 1.

17. The set of iron-type golf clubs according to claim 1 comprising at least three clubs, wherein a club head moment of inertia about a vertical axis that passes through a center of gravity of a club head hitting face is in accordance with $$I_{yy}=\alpha*(0.9LA_{deg}+190.48)$$

wherein LA is a loft angle measured in degrees $I_{yy}$ is the moment of inertia of the club head about a vertical axis that passes through the center of gravity of the face, and $\alpha$ ranges from about 0.8 to about 1.2.

18. The set of clubs according to claim 17, wherein $\alpha$ is about 1.

19. The set of iron-type golf clubs according to claim 1 comprising at least three clubs, wherein a club head moment of inertia about a shaft axis is in accordance with $$I_{sa}=\alpha*(3.87LA+383.88)$$

wherein LA is a loft angle measured in degrees $I_{sa}$ is the moment of inertia of the club head about the shaft axis, and $\alpha$ ranges from about 0.8 to about 1.2.

20. The set of clubs according to claim 19, wherein $\alpha$ is about 1.

21. A set of iron-type golf clubs comprising:

at least one cavity back club;

at least one muscle back club; and wherein the clubs are made from forged stainless steel and at least one club design parameter is systematically varied through the set, and wherein the set comprises at least three clubs, wherein an offset (O) for each club is in accordance with $$O=\alpha*(0.2327*e^{-0.0236LA})$$

where LA is a loft angle in degrees, O is offset measured in inches, and $\alpha$ ranges from about 0.89 to about 1.11.

22. The set of clubs according to claim 21, wherein $\alpha$ is about 1.

* * * * *